US010179457B2

(12) United States Patent
Ueda

(10) Patent No.: US 10,179,457 B2
(45) Date of Patent: Jan. 15, 2019

(54) WASTE LIQUID TANK AND PRINTER

(71) Applicant: Brother Kogyo Kabushiki Kaisha, Nagoya-shi, Aichi-ken (JP)

(72) Inventor: Toshiro Ueda, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/662,763

(22) Filed: Jul. 28, 2017

(65) Prior Publication Data

US 2018/0072063 A1 Mar. 15, 2018

(30) Foreign Application Priority Data

Sep. 9, 2016 (JP) ..... 2016-176389

(51) Int. Cl.
*B41J 2/17* (2006.01)
*B41J 2/165* (2006.01)
*B41J 2/185* (2006.01)

(52) U.S. Cl.
CPC ..... *B41J 2/1721* (2013.01); *B41J 2/16523* (2013.01); *B41J 2002/1735* (2013.01); *B41J 2002/1856* (2013.01)

(58) Field of Classification Search
CPC ..... B41J 2/165; B41J 2/16523; B41J 2/1721; B41J 2002/1728; B41J 2002/1735; B41J 2002/1742; B41J 2002/1856
See application file for complete search history.

(56) References Cited

U.S. PATENT DOCUMENTS

2005/0195241 A1* 9/2005 Kawai et al. ..... B41J 2/165
2009/0015632 A1* 1/2009 Suzuki et al. ..... B41J 2/165
2011/0074872 A1* 3/2011 Ozaki et al. ..... B41J 2/165
2012/0236074 A1* 9/2012 Harada et al. ..... B41J 2/165

FOREIGN PATENT DOCUMENTS

JP H08-267781 A 10/1996
JP 2003-011394 A 1/2003
JP 2006-027040 A 2/2006
JP 2006-281508 A 10/2006
JP 5151285 B2 2/2013

* cited by examiner

*Primary Examiner* — Geoffrey S Mruk
*Assistant Examiner* — Scott A Richmond
(74) *Attorney, Agent, or Firm* — Banner & Witcoff, Ltd.

(57) ABSTRACT

A waste liquid tank includes a case. The case includes a first accommodating portion having an inlet and a first communication opening, a second accommodating portion having a second communication opening and a connecting portion connecting the first communication opening and the second communication opening, wherein a cross-sectional area of the connecting portion is less than a cross-sectional area of the first accommodating portion and is less than a cross-sectional of the second accommodating portion. The waste liquid tank includes a first absorber accommodated in the first accommodating portion, a second absorber accommodated in the second accommodating portion and a third absorber accommodated in the connecting portion. The connecting portion includes a passage defined between the third absorber and a peripheral portion of the connecting portion, the passage allowing the first accommodating portion to communicate with the second accommodating portion and for air to pass therethrough.

14 Claims, 10 Drawing Sheets

WASTE LIQUID TANK AND PRINTER

CROSS-REFERENCE TO RELATED APPLICATION

This application claims priority from Japanese Patent Application No. 2016-176389 filed on Sep. 9, 2016, the content of which is incorporated herein by reference in its entirety.

FIELD OF DISCLOSURE

Aspects disclosed herein relate to a waste liquid tank and a printer including the same.

BACKGROUND

Known waste liquid tanks include, for example, a waste ink tank that holds waste ink produced in a recording unit that ejects ink. The waste ink tank includes a first tank (e.g., an undetachable waste ink case) into which waste ink flows, a second tank (e.g., a detachable ink case), and a connecting portion (e.g., an insertion portion) that connects between the first tank and the second tank. The first tank, the second tank, and the connecting portion each accommodate therein an absorber (e.g., an ink holding member) for absorbing (e.g., holding) waste ink.

SUMMARY

In order to reduce or minimize liquid leakage from the waste liquid tank, no other opening may be provided to the second tank except a connection port for the connecting portion. In such a configuration, in order to cause liquid to move from the first tank into the second tank through the connecting portion, air staying in the second tank may need to be discharged into the first tank through the connecting portion.

In a case where the absorber occupies the entirety of the connecting portion and is in contact with the entirety of the surrounding walls of the connecting portion, the connecting portion may become clogged with liquid absorbed by the absorber if viscosity of the absorbed liquid increases. If such a problem occurs in the waste liquid tank including the second tank having no opening other than the connection port, air staying in the second tank might not be discharged to the outside of the second tank. This may prevent liquid from moving from the first tank to the second tank although the absorber accommodated in the second tank can still absorb liquid. Thus, the liquid holding capability of the waste liquid tank may be impaired.

Accordingly, some embodiments of the disclosure provide for a waste liquid tank in which impairment of liquid holding capability may be reduced or minimized.

According to the one or more aspects of the disclosure, the waste liquid tank in which impairment of liquid holding capability may be reduced or minimized may be provided.

A waste liquid tank according to an aspect of the present invention includes a case. The case includes a first accommodating portion having an inlet and a first communication opening, a second accommodating portion having a second communication opening and a connecting portion connecting the first communication opening and the second communication opening, wherein a cross-sectional area of the connecting portion is less than a cross-sectional area of the first accommodating portion and is less than a cross-sectional of the second accommodating portion. The waste liquid tank includes a first absorber accommodated in the first accommodating portion, a second absorber accommodated in the second accommodating portion and a third absorber accommodated in the connecting portion. The connecting portion includes a passage defined between the third absorber and a peripheral portion of the connecting portion, the passage allowing the first accommodating portion to communicate with the second accommodating portion and for air to pass therethrough.

A printer according to an aspect of the present invention includes a waste liquid tank including a case. The case includes a first accommodating portion having an inlet and a first communication opening, the first accommodating portion having a first absorber therein and a first passage that is not occupied by the first absorber, a second accommodating portion having a second communication opening, the second accommodating portion having a second absorber therein and a second passage that is not occupied by the second absorber, and a connecting portion connecting the first communication opening and the second communication opening, the connecting portion having a third absorber therein, a peripheral portion and a third passage not occupied by the third absorber, the third passage allowing the first passage of the first accommodating portion to communicate with the second passage of the second accommodating portion and for air to pass therethrough such that the first passage, the second passage and the third passage together define an air passage. The printer includes a discharge outlet for discharging waste liquid toward the inlet and a controller configured to select one of a plurality of modes in which a particular volume of waste liquid discharged during a time period through the discharge outlet toward the inlet is greater than a particular volume of waste liquid discharged during a time period through the discharge outlet toward the inlet in the other ones of the plurality of modes. A volume of the air passage is greater than the particular volume of the waste liquid discharged during the time period through the discharge outlet in the selected one of the plurality of modes.

In a further aspect of a printer including a waste liquid tank. The waste liquid tank includes a case having an absorber accommodated in the case, an air passage not occupied by the absorber, and an inlet. The printer includes a discharge outlet for discharging waste liquid toward the inlet of the case and a controller configured to select one of a plurality of modes in which a particular volume of waste liquid discharged during a time period through the discharge outlet toward the inlet is greater than a particular volume of waste liquid discharged during a time period through the discharge outlet toward the inlet in the other ones of the plurality of modes. A volume of the air passage is greater than the particular volume of the waste liquid discharged during the time period through the discharge outlet in the selected one of the plurality of modes.

BRIEF DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
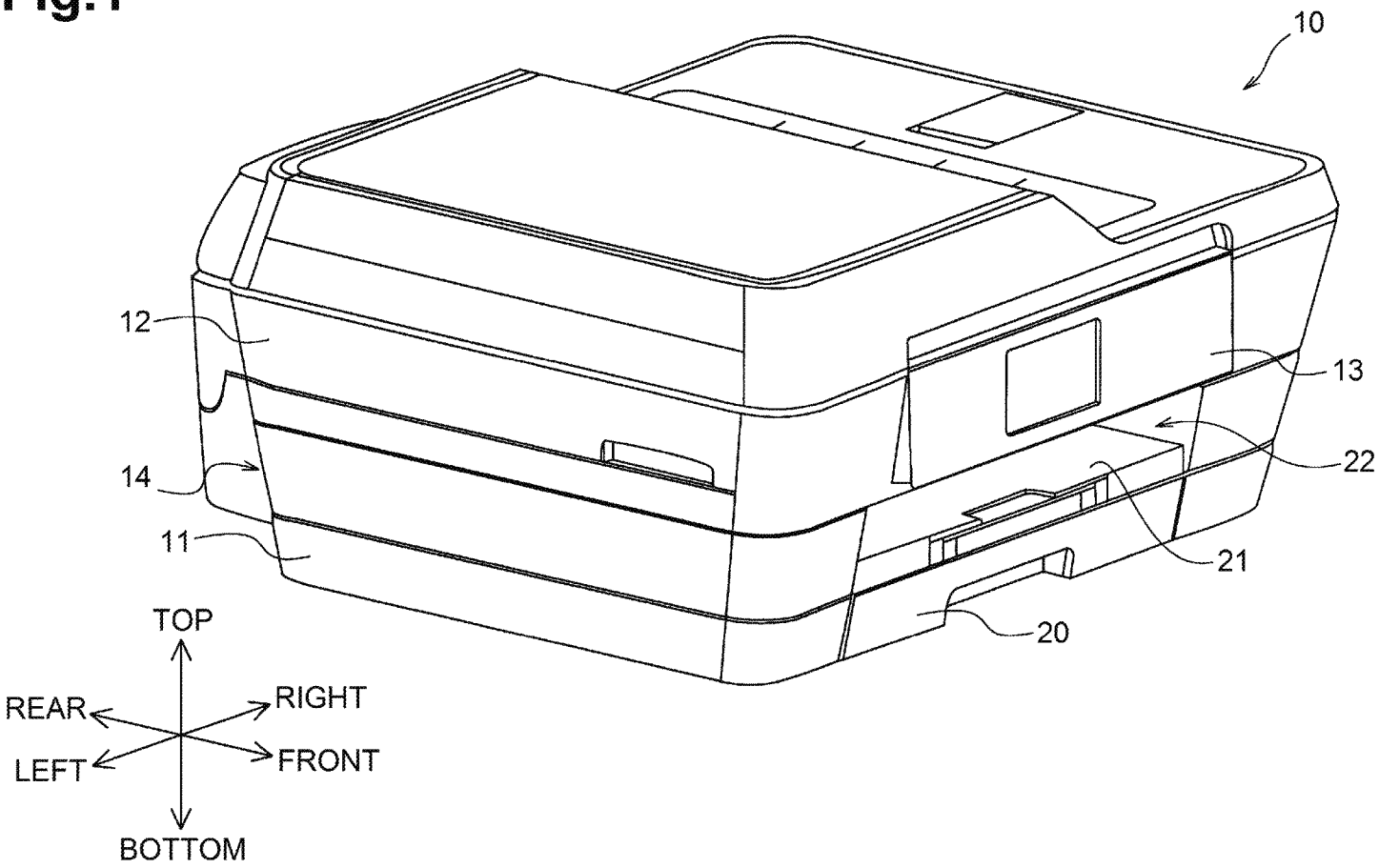
FIG. 1 is a perspective view of appearance of a multifunction device in an illustrative embodiment according to one or more aspects of the disclosure.

Hereinafter, an illustrative embodiment will be described with reference to the accompanying drawings. An overall configuration of a multifunction device 10 will be described. In the description below, as illustrated in FIG. 1, a top-bottom direction may be defined with reference to an orientation of the multifunction device 10 that may be disposed in an orientation in which it may be intended to be used. A side of the multifunction device 10, in which an opening 22 may be provided, may be defined as the front of the multifunction device 10. The rear, right, and left may be defined respectively with reference to the front of the multifunction device 1. The front-rear direction and the right-left direction may be parallel to the horizontal plane, and the top-bottom direction may be perpendicular to the horizontal plane.

[Overall Configuration of Multifunction Device]

The multifunction device 10 has multiple functions, e.g., a printing function and a scanning function. As illustrated in FIG. 1, the multifunction device 10 includes a printer housing 11 and a scanner housing 12 disposed above the printer housing 11. The printer housing 11 and the scanner housing 12 constitute exterior portions of the multifunction device 10 having a substantially rectangular parallelepiped shape. The multifunction device 10 includes an operation panel 13 at its front. The operation panel 13 includes various buttons and a liquid crystal display.

Figure 2:
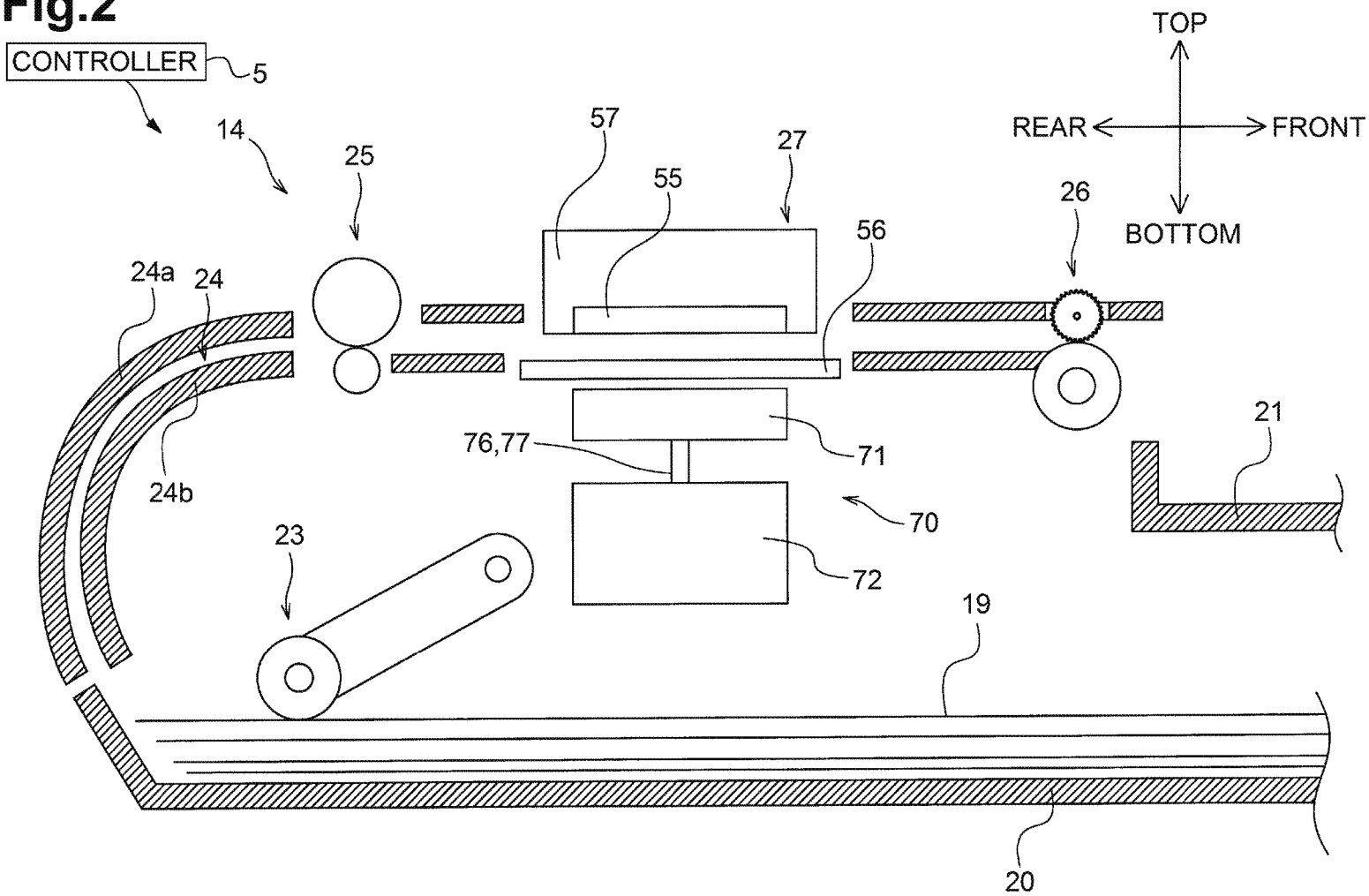
FIG. 2 is a schematic view of an internal configuration of a printer housing in the illustrative embodiment according to one or more aspects of the disclosure.

The printer housing 11 constitutes exterior walls of a printer 14 that is configured to record an image onto a recording sheet 19. More specifically, as illustrated in FIG. 2, the printer 14 is configured to record an image onto a recording sheet 19 fed from a feed tray 20 and discharge the recording sheet 19 having the recorded image to a discharge tray 21. The feed tray 20 and the discharge tray 21 are attachable to and detachable from the printer housing 11 through the opening 22 defined in the front of the printer housing 11. The scanner housing 12 constitutes exterior walls of an image reading device including a flatbed scanner.

[Printer]

The printer 14 includes a feed roller 23, a conveyor roller pair 25, a discharge roller pair 26, a recording unit 27, a purge mechanism 70, a first waste-liquid tank 80 (refer to FIG. 3), and a second waste-liquid tank 90 (refer to FIG. 3), and a controller 5.

The feed roller 23 is configured to rotate by transmission of a drive force from a motor (not illustrated) to feed a recording sheet 19 from the feed tray 20 toward a conveyance path 24 under control of the controller 5.

The conveyance path 24 is defined by guides 24*a* and 24*b* that face each other and are spaced from each other at a predetermined interval. The conveyance path 24 extends upward from a rear end of the feed tray 20 and curves toward the front of the printer 14. The conveyance path 24 then further extends substantially linearly toward the discharge tray 21 along the front-rear direction. The conveyance path 24 is positioned at a substantially middle area within the printer housing 11 with respect to the right-left direction.

The conveyor roller pair 25 is configured to rotate by transmission of a drive force from a motor (not illustrated) to convey the recording sheet 19 fed from the feed tray 20 toward the recording unit 27 along the conveyance path 24 under control of the controller 5. The discharge roller pair 26 is configured to rotate by transmission of a drive force from a motor (not illustrated) to further convey the recording sheet 19 conveyed by the feed tray 25 and discharge the recording sheet 19 onto the discharge tray 21 under control of the controller 5.

The recording unit 27 is configured to record an image by an inkjet recording method. The recording unit 27 includes a recording head 55 and a carriage 57. The carriage 57 is disposed above the conveyance path 24. The carriage 57 is configured to move along a guide rail (not illustrated), which extends in the right-left direction, by transmission of a drive force of a motor (not illustrated) via a belt driving mechanism (not illustrated). The recording head 55 is mounted on the carriage 57. A platen 56 is disposed below the recording head 55. The platen 56 extends throughout a movable range of the carriage 57 (e.g., entirety of the conveyance path 24 in the right-left direction). The platen 56 is configured to support from below a recording sheet 19 being conveyed along the conveyance path 24. The recording head 55 faces the platen 56. While the carriage 57 reciprocates along the right-left direction, the recording head 55 records an image onto a recording sheet 19 by selectively ejecting ink (e.g., liquid) onto the recording sheet 19 supported by the platen 56.

Figure 3:
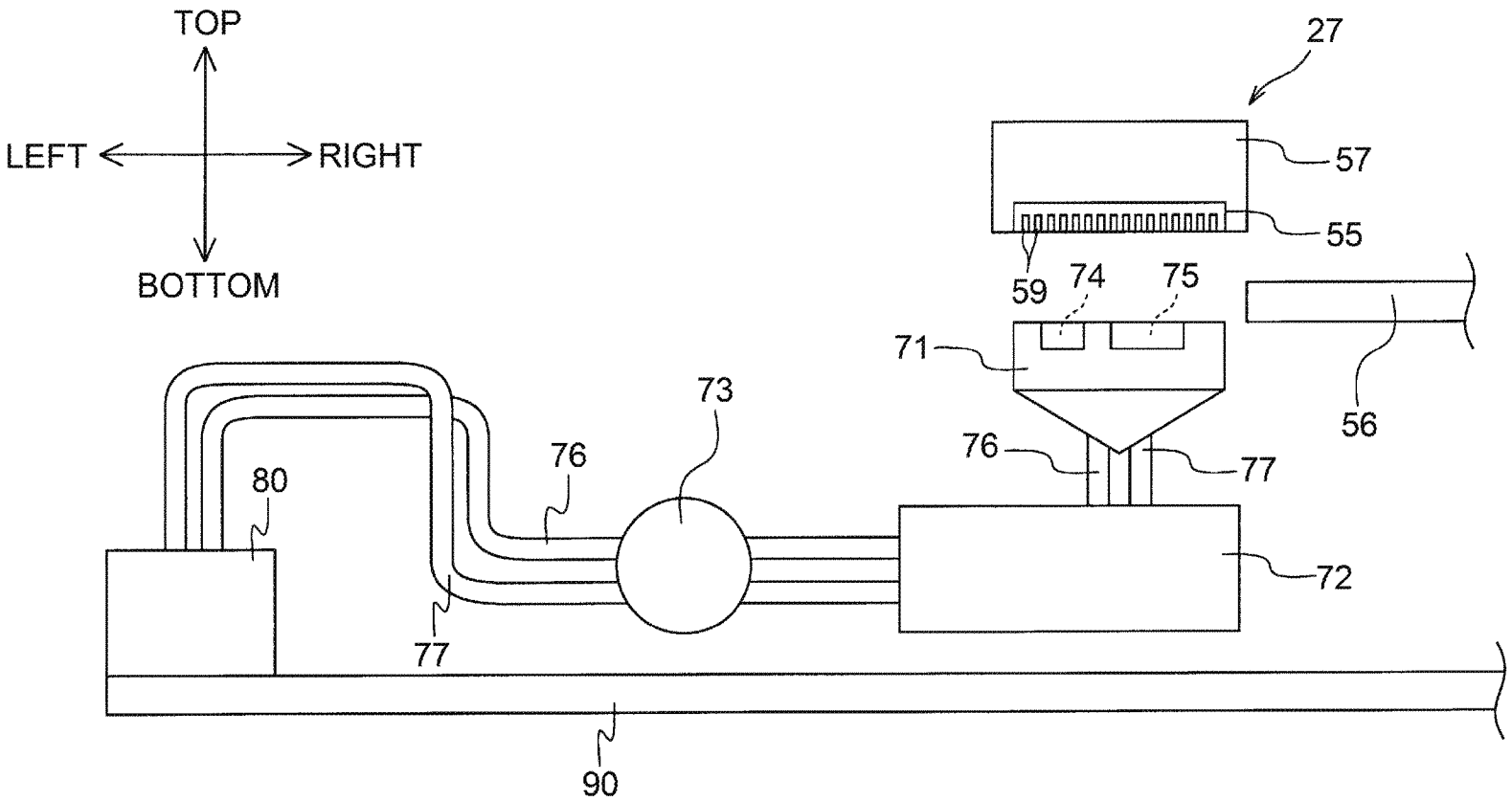
FIG. 3 is a schematic view of a purge mechanism, a first waste-liquid tank, and a second waste-liquid tank in the illustrative embodiment according to one or more aspects of the disclosure.

As illustrated in FIG. 3, the recording head 55 has a lower surface that may be an ejection surface having a plurality of nozzles 59 defined therein. The ejection surface has a plurality of, for example, four nozzle rows, in each of which the nozzles 59 are arrayed along the right-left direction. The nozzle rows are next to each other in the front-rear direction. The nozzle rows may correspond to respective ink colors of four, for example, cyan, magenta, yellow, and black. The recording head 55 is connected to each ink cartridge that stores a respective color ink. The inks stored in the respective ink cartridges are supplied to the recording head 55.

Figure 4:
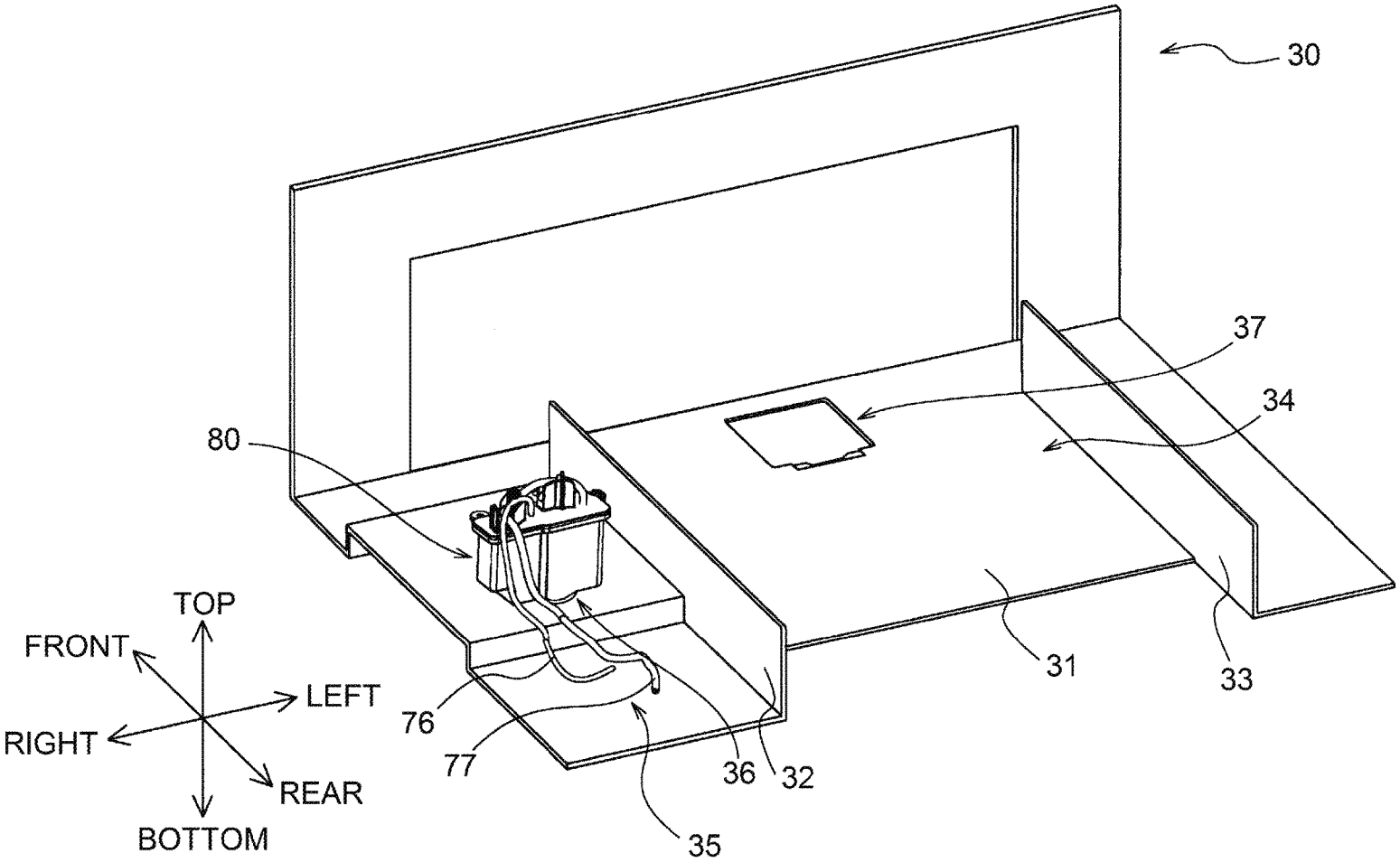
FIG. 4 is a perspective view of a lower cover and the first waste-liquid tank in the illustrative embodiment according to one or more aspects of the disclosure.

As illustrated in FIG. 4, the printer housing 11 includes a lower cover 30 that mainly constitutes a lower surface and a portion of a front surface of the multifunction device 10. The printer housing 11 further includes an upper cover (not illustrated) that mainly constitutes side surfaces and a rear surface of the multifunction device 10. The upper cover is disposed above the lower cover 30. An assembly of the upper cover and the lower cover 30 constitutes the printer housing 11.

The lower cover 30 includes a lower wall 31, a right wall 32, and a left wall 33. The lower wall 31 constitutes the lower surface. The right wall 32 and the left wall 33 define a space 34 where the feed tray 20 may be accommodated. The right wall 32 and the left wall 33 each protrude upward from the lower wall 31 and extend along the front-rear direction. The space 34 is defined by the right wall 32 and the left wall 33 at a substantially middle portion of the lower wall 31 in the right-left direction. In the lower cover 30, another space 35 is defined above the lower wall 31 and further to the right than the right wall 32. The purge mechanism 70 and the first waste-liquid tank 80 are disposed in the space 35. The second waste-liquid tank 90 is disposed below the lower cover 30. That is, the first waste-liquid tank 80 is disposed above the second waste-liquid tank 90. In FIG. 4, the purge mechanism 70 is omitted.

The purge mechanism 70 is configured to perform suction purge in which ink is caused to be discharged from each nozzle 59 of the recording head 55 by sucking. The first waste-liquid tank 80 and the second waste-liquid tank 90 are configured to hold collected ink that has been discharged from each nozzle 59 by suction purge performed by the purge mechanism 70.

The controller 5 is configured to control operation of each unit and/or component of the printer to control overall operation of the multifunction device 10. The controller 5 is configured to control the recording unit 27 to perform printing, in which the recording unit 27 records an image onto a recording sheet 19, based on a print instruction (e.g., image data) provided from an external device, e.g., a personal computer connected to the multifunction device 10. The controller 5 is further configured to control the purge mechanism 70 to perform purging, e.g., suction purge. In this illustrative embodiment, the suction purge includes a plurality of modes, which may include, for example, a strong purge mode which is one of manual purge modes performed in response to a user's operation on the operation panel 13. An amount of ink sucked from the nozzles 59 per unit of time in purging in the strong purge mode is greater and a total amount of sucked ink in purging in the strong purge mode is also greater than those in purging in any of the other modes.

[Configuration of Purge Mechanism]

As illustrated in FIG. 2, the purge mechanism 70 is disposed below a path in which the recording head 55 moves and further to the left than a right end of the platen 56. The tubes 76 and 77 are disposed in the space 35 (refer to FIG. 4). The purge mechanism 70 is configured to suck ink from each nozzle 59 of the recording head 55 and discharge the sucked ink into the first waste-liquid tank 80. Hereinafter, ink sucked from each nozzle 59 by the purge mechanism 70 is referred to as "waste ink". In FIG. 3, the first waste-liquid tank 80 is schematically illustrated for showing that the purge mechanism 70 and the first waste-liquid tank 80 are connected to each other via tubes 76 and 77. Nevertheless, the location of the first waste-liquid tank 80 relative to the other units or components might not be limited to the positional relationship illustrated in FIG. 3.

The purge mechanism 70 includes a movable portion 71, a cam mechanism 72, a plurality of, for example, two tubes 76 and 77, and a pump 73. The movable portion 71 includes caps 74 and 75 made of, for example, rubber material. The caps 74 and 75 face the lower surface of the recording head 55 in the top-bottom direction when the carriage 57 is located vertically above the movable portion 71. The cam mechanism 72 is configured to operate by transmission of a drive force from a motor (not illustrated) to move the movable unit 71 in the top-bottom direction. The caps 74 and 75 contact the lower surface of the recording head 55 by upward movement of the movable portion 71. In a state where the caps 74 and 75 contact the lower surface of the recording head 55, the cap 74 covers one (e.g., a nozzle row corresponding to black ink) of the nozzle rows and the cap 75 covers the remainder (e.g., the other three nozzle rows corresponding to cyan ink, magenta ink, and yellow ink, respectively) of the nozzle rows. The tube 76 has one end that is connected to the cap 74. The tube 77 has one end that is connected to the cap 75. The tubes 76 and 77 may be flexible tubes made of resin.

The pump 73 may be a rotary tube pump that is configured to operate by transmission of a drive force from a motor (not illustrated). The pump 73 is in communication with a space that may become a hermetically sealed space when the lower surface of the recording head 55 and the caps 74 and 75 contact each other. The pump 73 is in communication with the space via the tubes 76 and 77. When the pump 73 is driven while the caps 74 and 75 cover the corresponding nozzles 59, pressure in each of the caps 74 and 75 becomes negative and waste ink is sucked from the nozzles 59. Thus, the sucked ink is received by the caps 74 and 75. The waste ink received by the caps 74 and 75 flows into the first waste-liquid tank 80 via the tubes 76 and 77 by operation of the pump 73 and then further moves into the second waste-liquid tank 90. The tube 76 may define a waste ink passage in which waste ink flows mainly, and the tube 77 may define an air passage in which air flows mainly.

[First Waste-Liquid Tank]

As illustrated in FIG. 4, the first waste-liquid tank 80 is disposed in the space 35 of the lower cover 30. Although not illustrated in FIG. 4, the purge mechanism 70 is disposed behind the first waste-liquid tank 80. The tubes 76 and 77 extend frontward from the purge mechanism 70 and are connected to the first waste-liquid tank 80. The lower cover 30 has a through hole 36 in its lower wall 31 in the space 35. The first waste-liquid tank 80 includes a cylindrical portion 87 (shown in FIG. 5), which is engaged with the through hole 36 by insertion and is fastened to the lower cover 30 by a screw.

Figure 5:
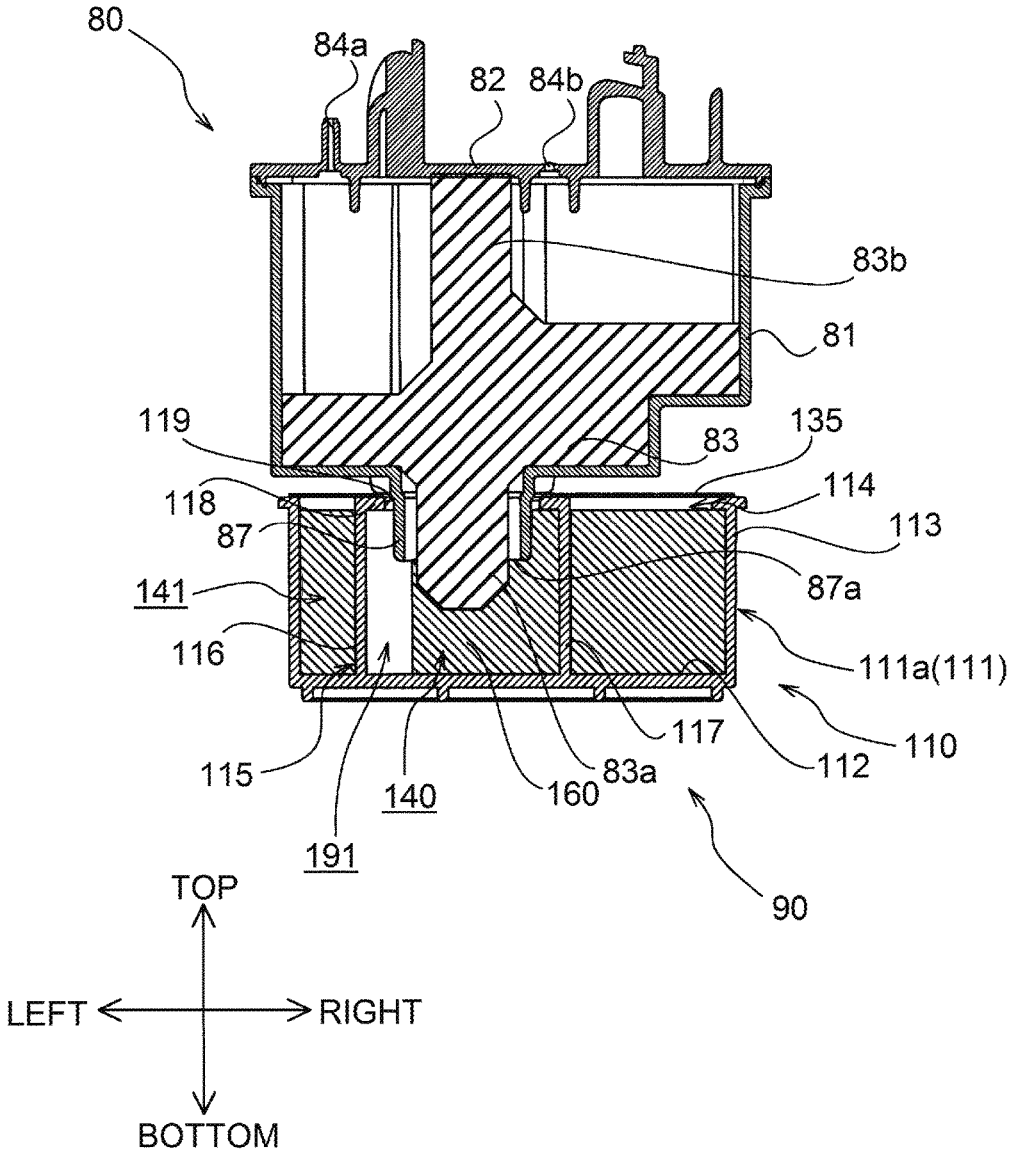
FIG. 5 is a cross-sectional view of the first waste-liquid tank and the second waste-liquid tank in the illustrative embodiment according to one or more aspects of the disclosure.

As illustrated in FIG. 5, the first waste-liquid tank 80 includes a body case 81, a cover 82, and an absorber 83. The body case 81 has a hollow box shape with an upper opening. The opening of the body case 81 is closed by the cover 82. The cover 82 has a port **84*a* to which the other end of the tube 76 is connected, and another port 84*b* to which the other end of the tube 77 is connected. Each of the ports 84*a* and 84*b* has a hollow cylindrical shape and protrudes upward relative to the cover 82. The ports 84*a* and 84*b* provide communication between an internal space and the outside of the body case 81**.

The body case 81 further includes the cylindrical portion 87 that extends downward from its lower wall. The cylindrical portion 87 is hollow and has an opening **87*a* at its lower end. The cylindrical portion 87 provides communication between the internal space and the outside of the body case 81**.

The body case 81 accommodates the absorber 83 in its internal space. The absorber 83 may be made of fiber material, for example, felt molding. Waste ink that flows into the internal space of the body case 81 via the port 84*a* may be absorbed and held by the absorber 83.

The absorber 83 extends in the internal space of the body case 81 to cover substantially the entirety of the lower wall of the body case 81. A major portion of the absorber 83 is positioned at a substantially lower portion of the internal space of the body case 81. Therefore, the body case 81 has empty areas that are not occupied by any portions of the absorber 83. The empty areas are defined between the absorber 83 and the cover 82 in the inside of the body case 81.

The absorber 83 has a protruding portion 83*a* that protrudes downward. The protruding portion 83*a* extends into an internal space of the cylindrical portion 87 of the body case 81 and a lower end portion of the protruding portion 83*a* further extends to the outside of the body case 81 via the opening 87*a* of the cylindrical portion 87. That is, the absorber 83 extends beyond the lower end of the body case 81 and the lower end portion of the absorber 83 is exposed to the outside of the body case 81. Clearance is left between an internal wall of the cylindrical portion 87 and the protruding portion 83*a* of the absorber 83.

The absorber 83 has another protruding portion 83*b* that protrudes upward. The protruding portion 83*b* is positioned substantially vertically above the protruding portion 83*a*. An upper end surface of the protruding portion 83*b* is in contact with a portion of the cover 82 between the ports 84*a* and 85*b* in the internal space of the body case 81. The absorber 83 is not in contact with the cover 82 at any portion other than upper end surface of the protruding portion 83*b*. Thus, the internal space of the body case 81 is partitioned into a plurality of spaces by the protruding portion 83*b*: one is a space with which the port 84*a* is in communication and another is a space with which the port 84*b* is in communication. This configuration may therefore enable the absorber 83 to reduce or prevent waste ink that has flowed into the internal space of the body case 81 via the port 84*a* from moving toward the port 84*b*.

[Second Waste-Liquid Tank]

Figure 6:
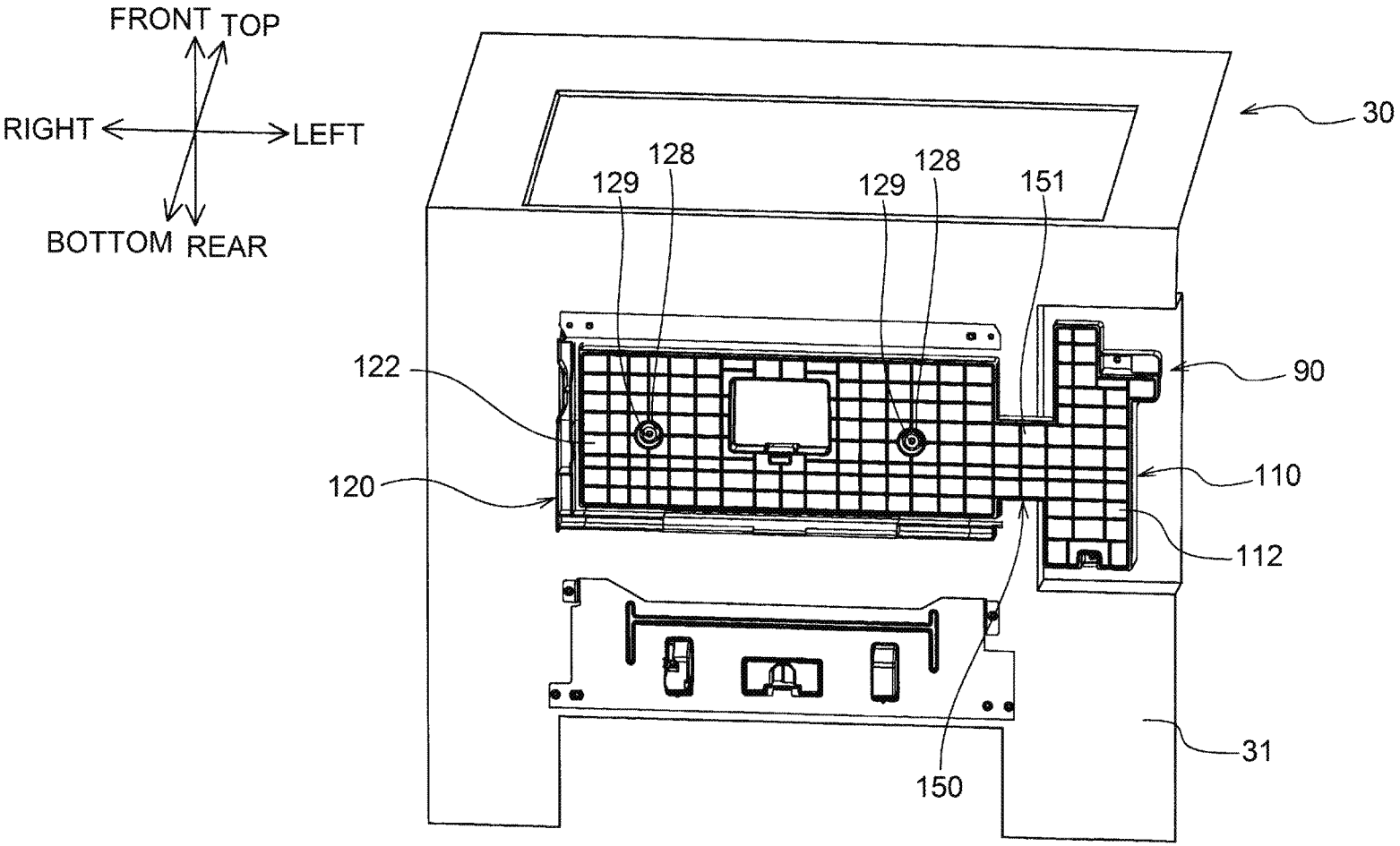
FIG. 6 is a perspective view of the lower cover and the second waste-liquid tank in the illustrative embodiment according to one or more aspects of the disclosure.

As illustrated in FIG. 6, the second waste-liquid tank 90 is disposed below the lower wall 31 of the lower cover 30. The cylindrical portion 87 of the first waste-liquid tank 80, which is disposed above the lower wall 31 of the lower cover 30, protrudes downward beyond the lower wall 31 through the through hole 36 of the lower wall 31 as understood from FIGS. 4 and 5.

Figure 7:
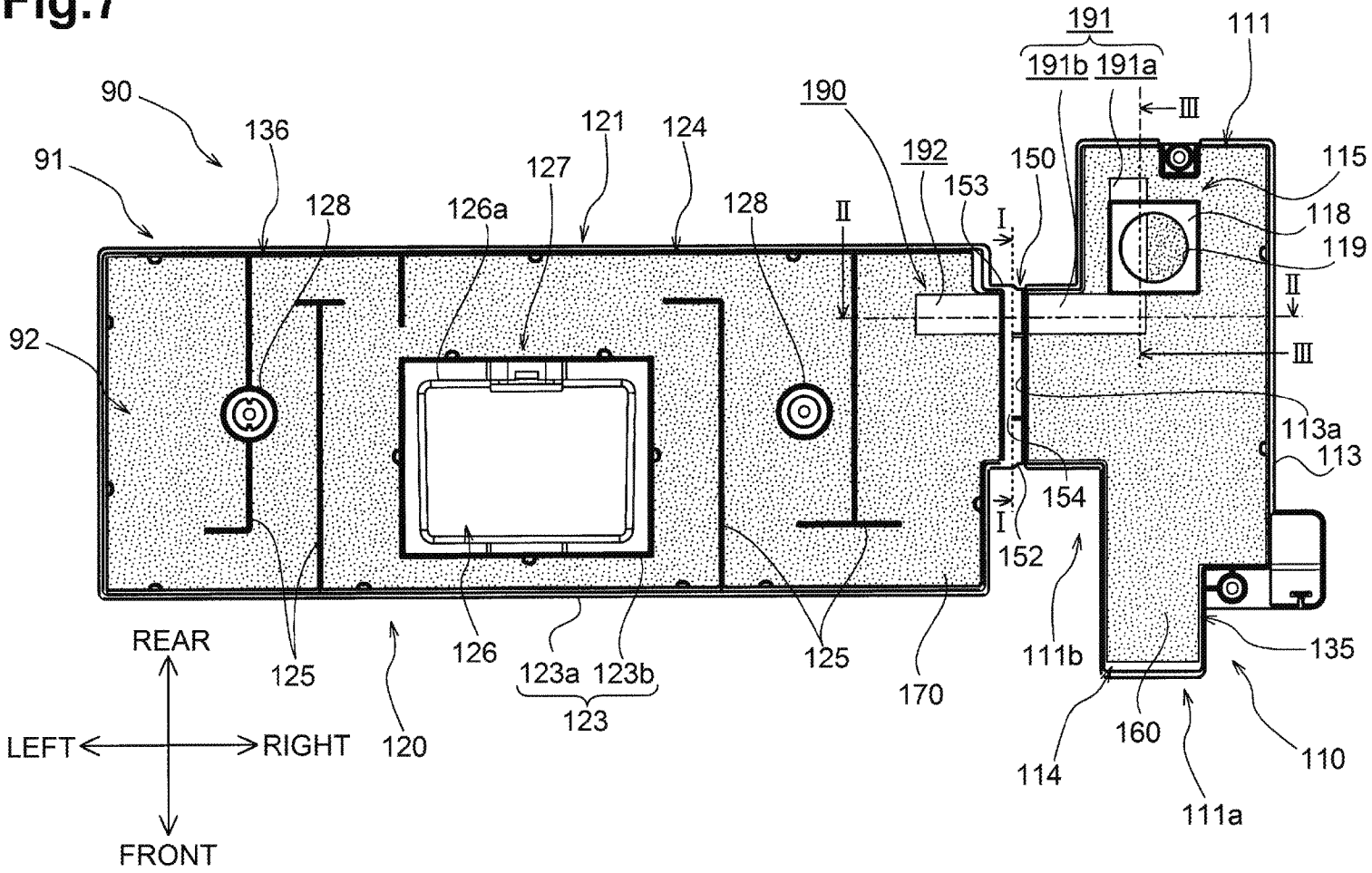
FIG. 7 is a top plan view of the second waste-liquid tank in the illustrative embodiment according to one or more aspects of the disclosure.
Figure 8:
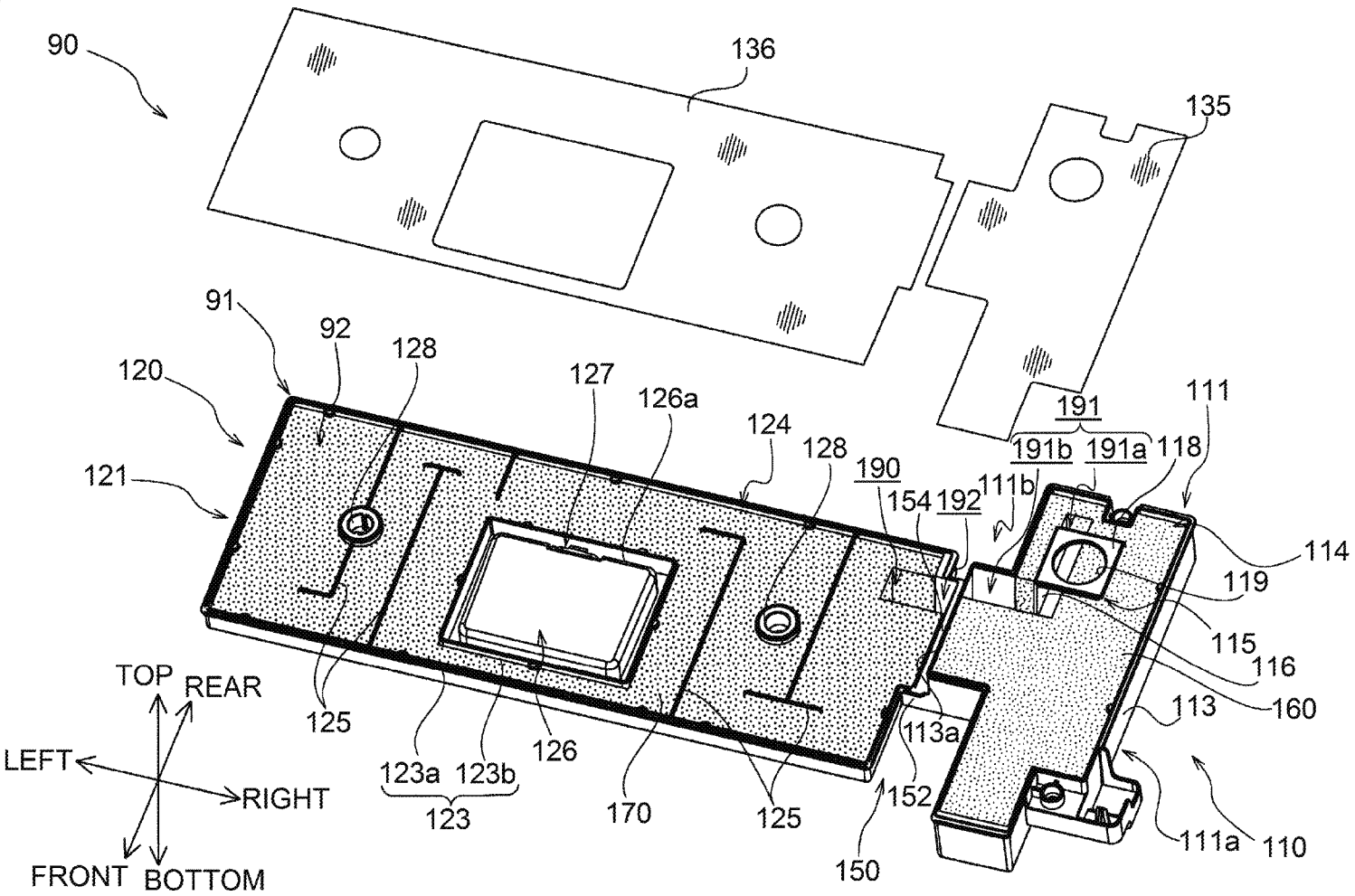
FIG. 8 is a perspective view of the second waste-liquid tank without a film in the illustrative embodiment according to one or more aspects of the disclosure.

As illustrated in FIGS. 7 and 8, the second waste-liquid tank 90 includes a case 91 and an absorber 92. The second waste-liquid tank 90 has a larger capacity than the first waste-liquid tank 80 and thus is capable of holding therein a larger amount of waste ink than the first waste-liquid tank 80.

The case 91 is configured to accommodate the absorber 92, and includes a first accommodating portion 110, a second accommodating portion 120, and a connecting portion 150. The absorber 92 may be a liquid absorber and may be made of fiber material, for example, felt molding. The absorber 92 includes a first absorbing member 160, a second absorbing member 170, and a third absorbing member 180 (refer to FIG. 9A). The first absorbing member 160 is accommodated in the first accommodating portion 110. The second absorbing member 170 is accommodated in the second accommodating portion 120. The third absorbing member 180 is accommodated in the connecting portion 150.

The first accommodating portion 110 includes a housing 111 and a film 135. The housing 111 has a lower wall 112 (refer to FIG. 6) and a sidewall 113 that extends upward from an edge of the lower wall 112. The sidewall 113 has an upper end that defines an opening 114 of the housing 111. That is, the housing 111 has a hollow box-like shape with its upper end opened. The housing 111 may be made of, for example, synthetic resin or plastic.

Figure 9A:
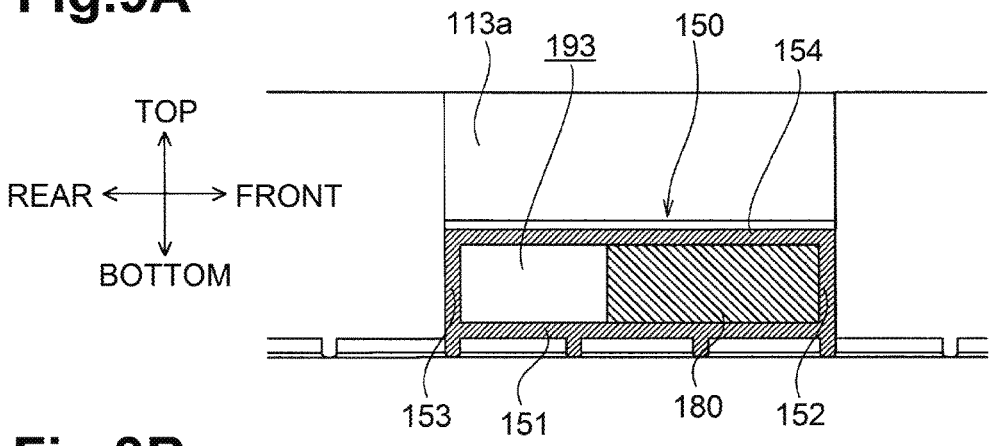
FIG. 9A is a cross-sectional view taken along line I-I of FIG. 7 in the illustrative embodiment according to one or more aspects of the disclosure.
Figure 9B:
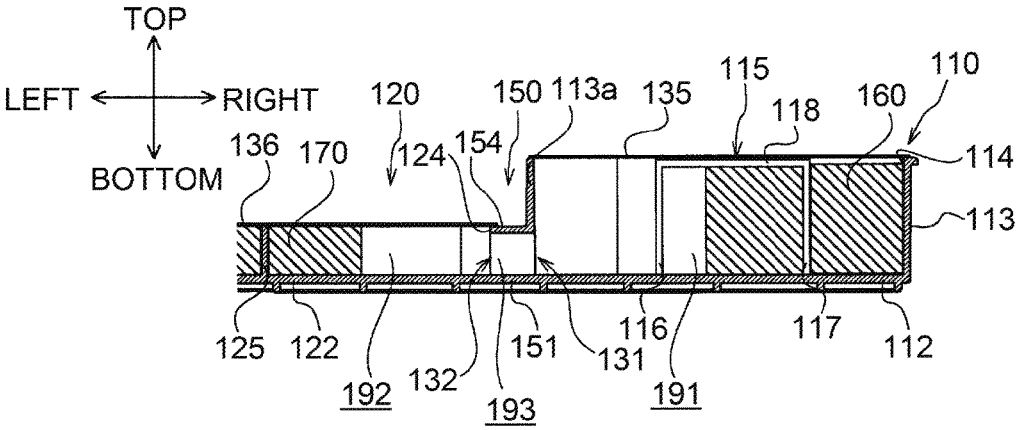
FIG. 9B is a cross-sectional view taken along line II-II of FIG. 7 in the illustrative embodiment according to one or more aspects of the disclosure.

The housing 111 includes a main portion 111*a* and a projecting portion 111*b*. The main portion 111*a* has a substantially rectangular parallelepiped shape extending in the front-rear direction. The projecting portion 111*b* protrudes leftward from a substantially middle portion of the main portion 111*a* in the front-rear direction. As illustrated in FIG. 9B, the sidewall 113 has a sidewall portion 113*a* that extends in the front-rear direction and corresponds to a distal end of the projecting portion 111*b*. The sidewall portion 113*a* has a communication opening 131 at its lower portion. The communication opening 131 is in communication with an internal space of the connecting portion 150. A lower edge of the communication opening 131 is coplanar with an upper surface of the lower wall 112 in the top-bottom direction.

As illustrated in FIGS. 5, 7, and 8, the housing 111 further includes a joint portion 115 that protrudes upward from another portion of the lower wall 112 of the main portion 111*a*. The joint portion 115 is disposed further to the rear than the communication opening 131, and includes a left plate 116, a right plate 117, and an upper plate 118. The left plate 116 and the right plate 117 each extend upward from the lower wall 112 and also extend in the right-left direction. An upper end of the left plate 116 and an upper end of the right plate 117 are at the same level as the upper end of the sidewall 113 in the top-bottom direction. The left plate 116 and the right plate 117 face each other with respect to the right-left direction. The upper plate 118 extends in the right-left direction and is connected between the upper end of the left plate 116 and the upper end of the right plate 117.

The upper plate 118 of the joint portion 115 has an inlet 119 at a substantially central portion. The inlet 119 is a circular through hole that penetrates the upper plate 118 in the top-bottom direction. In a state where the first waste-liquid tank 80 and the second waste-liquid tank 90 are fixed to the lower cover 30, the cylindrical portion 87 of the body case 81 of the first waste-liquid tank 80 is engaged with the inlet 119 by insertion. Waste ink may move to the second waste-liquid tank 90 from the first waste-liquid tank 80 through the absorber 83 that extends to the outside from the cylindrical portion 87, i.e., through the inlet 119.

The film 135 may be a transparent flexible member made of, for example resin material. The film 135 is fixed to the upper end of the sidewall 113 of the housing 111 to cover the opening 114 of the housing 111. Therefore, the film 135 and the housing 111 constitute surrounding walls that surround the first absorbing member 160 accommodated in the first accommodating portion 110. The film 135 constitutes an upper wall. The film 135 has stiffness less than the housing 111 made of synthetic resin or plastic. Therefore, of the surrounding walls of the first accommodating portion 110, the upper wall constituted by the film 135 has stiffness less than the other walls.

The film 135 has an opening at a location corresponding to the inlet 119 of the upper plate 118 of the joint portion 115. Thus, the first accommodating portion 110 is closed except the inlet 119 and the communication opening 131.

In the first waste-liquid tank 80, clearance is left between the internal wall of the cylindrical portion 87 and the protruding portion 83*a* of the absorber 83. This configuration may therefore enable the internal space of the case 81 to be in communication with the atmosphere via the clearance, the first waste-liquid tank 80, and the tube 76. That is, the internal space of the case 91 is in communication with the atmosphere through the inlet 119. In the case 91, the inlet 119 is the only opening that is in communication with the atmosphere.

Figure 9C:
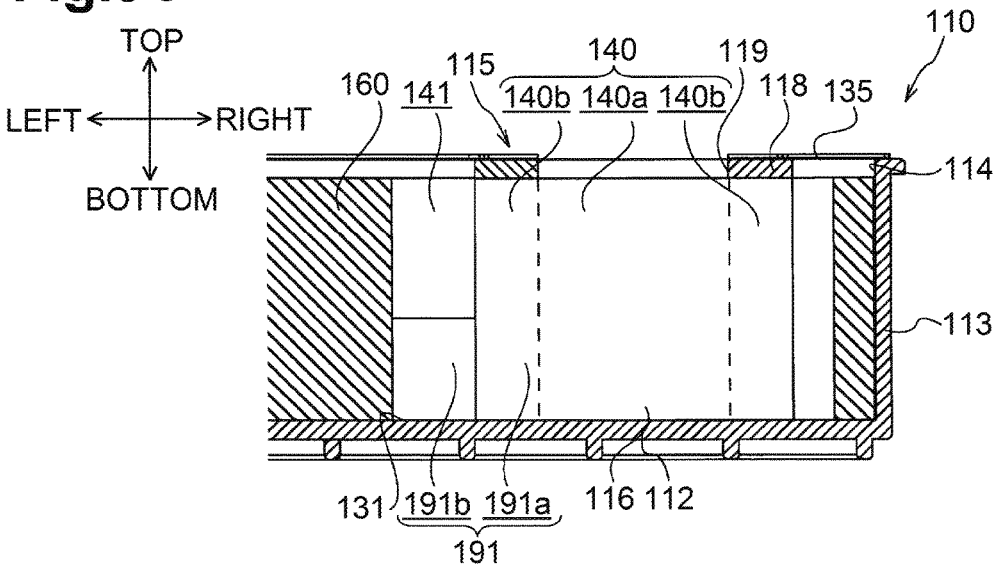
FIG. 9C is a cross-sectional view taken along line III-III of FIG. 7 in the illustrative embodiment according to one or more aspects of the disclosure.

As illustrated in FIG. 9C, the internal space of the first accommodating portion 110 includes a first subspace 140 and a second subspace 141. The first subspace 140 is defined within the connecting portion 150. The second subspace 141 is defined as the remainder of the internal space of the first accommodating portion 110 and is outside the joint portion 115. The first subspace 140 has an open front and an open rear while the left and right of the first subspace 140 are defined by the left plate 116 and the right plate 117, respectively. The first subspace 140 includes a first area 140*a* and a second area 140*b*. The first area 140*a* overlaps the inlet 119 in top plan view. The second area 140*b* does not overlap the inlet 119 but overlaps the remaining portion of the upper plate 118 in top plan view. The second area 140*b* connects between the first area 140*a* and the second subspace 141. Waste ink moves to the first area 140*a* via the inlet 119 from the first waste-liquid tank 80. The waste ink then moves to the second area 140*b* and further moves to the second subspace 141. The waste ink then moves to the connecting portion 150 via the communication opening 131.

As illustrated in FIGS. 7 and 8, the second accommodating portion 120 includes a housing 121 and a film 136. The housing 121 has a substantially rectangular parallelepiped shape extending in the right-left direction. The housing 121 includes a lower wall 122 (refer to FIG. 6) and a sidewall 123. The sidewall 123 includes an outer sidewall 123*a* and an inner sidewall 123*b*. The outer sidewall 123*a* extends upward from an edge of the lower wall 122. The inner sidewall 123*b* surrounds an engagement portion 126 that is disposed at a substantially middle portion of the lower wall 122 in the right-left direction. The outer sidewall 123*a* and the inner sidewall 123*b* have upper ends that define a rectangular ring-shaped opening 124. That is, the housing 121 has a hollow box-like shape with its upper end opened. The housing 121 may be made of, for example, synthetic resin or plastic, similar to the housing 111.

The lower wall 122 is coplanar with the lower wall 112 of the first accommodating portion 110. The sidewall 123 has a height shorter than the sidewall 113 of the first accommodating portion 110. Therefore, the second accommodating portion 120 has a height shorter than the first accommodating portion 110. The second accommodating portion 120 is wider than the projecting portion 111*b* of the first accommodating portion 110 in the front-rear direction. As illustrated in FIG. 9B, the outer sidewall 123*a* of the housing 121 has a communication opening 132 that faces the projecting portion 111*b* of the first accommodating portion 110. The communication opening 132 is in communication with the internal space of the connecting portion 150. The communication opening 132 faces the communication opening 131 of the first accommodating portion 110 and has the same cross-sectional area as the communication opening 131.

The housing 121 includes a plurality of ribs 125. The ribs 125 each protrude upward from the lower wall 122 and extend along the front-rear direction. Each of the ribs 125 may have a bent end at its front or rear end. Each bent end extends toward the right and/or the left. Therefore, each of the ribs 125 has a hook-like shape in top plan view. The ribs 125 are spaced apart from each other in the right-left direction.

The housing 121 includes the engagement portion 126 at its substantially middle portion in the right-left direction. The engagement portion 126 protrudes upward from the lower wall 122. The engagement portion 126 has a substantially rectangular parallelepiped shape. The engagement portion 126 includes an engagement hook 127 at its rear surface 126*a*. The engagement hook 127 extends upward such that its further upper portion is further from the rear surface 126*a*. The engagement hook 127 has a bent distal end having a hook-like shape. The engagement hook 127 is elastically deformable toward the rear surface 126*a*.

As illustrated in FIG. 4, the lower cover 30 has a through hole 37 in its lower wall 31. The through hole 37 has a rectangular shape in top plan view and its shape corresponds to an external shape of the engagement portion 126. The engagement portion 126 is configured to be engaged with the through hole 37. In a state where the engagement portion 126 is engaged with the through hole 37, the engagement hook 127 is in engagement with an edge of the through hole 37. Thus, the second accommodating portion 120 is fixed below the lower wall 31 of the lower cover 30 so as not to fall therefrom.

As illustrated in FIGS. 7 and 8, the second accommodating portion 120 further includes a plurality of, for example, two hollow cylindrical protrusions 128 that protrude upward from the lower wall 122. The protrusions 128 each function as a hole for receiving a screw 129 (refer to FIG. 6). In the state where the second accommodating portion 120 is positioned below the lower wall 31 of the lower cover 30, the screws 129 are screwed into the lower wall 31 of the lower cover 30 via the protrusions 128. Thus, the second accommodating portion 120 is fixed to the lower cover 30.

Similar to the film 135, the film 136 may be a transparent flexible member made of, for example resin material. The film 136 is fixed to an upper end of the sidewall 123 of the housing 121 to cover the opening 124 of the housing 121 except the protrusions 128. Therefore, the film 136 and the housing 121 constitute surrounding walls that surround the second absorbing member 170 accommodated in the second accommodating portion 120. The film 136 constitutes an upper wall. Thus, the second accommodating portion 120 is closed except the communication opening 132.

The connecting portion 150 has a substantially rectangular parallelepiped shape and extends linearly in the right-left direction. The connecting portion 150 connects the communication opening 131 of the first accommodating portion 110 and the communication opening 132 of the second accommodating portion 120. That is, the connecting portion 150 connects the first accommodating portion 110 and the second accommodating portion 120. As illustrated in FIG. 9A, the connecting portion 150 includes a lower wall 151, a front wall 152, a rear wall 153, and an upper wall 154. The front wall 152 extends upward from a front end of the lower wall 151. The rear wall 153 extends upward from a rear end of the lower wall 151. The upper wall 154 connects an upper end of the front wall 152 and an upper end of the rear wall 153. The lower wall 151, the front wall 152, the rear wall 153, and the upper wall 154 define a space that provides communication between the internal space of the first accommodating portion 110 and the internal space of the second accommodating portion 120, and surround the third absorbing member 180. A distance between the front wall 152 and the rear wall 153 in the front-rear direction is greater than a distance between the lower wall 151 and the upper wall 154 in the top-bottom direction. Thus, a cross-section of the internal space of the connecting portion 150 that extends parallel to the top-bottom direction and the front-rear direction has a rectangular shape. The lower wall 151 is coplanar with the lower wall 112 of the first accommodating portion 110 and the lower wall 122 of the second accommodating portion 120. The front wall 152 and the rear wall 153 each have a height shorter than the sidewall 113 of the first accommodating portion 110 while having the same height as the sidewall 123 of the second accommodating portion 120. Thus, the connecting portion 150 is located lower than the inlet 119.

The connecting portion 150 may be made of, for example, synthetic resin or plastic similar to the housing 111 of the first accommodating portion 110 and the housing 121 of the second accommodating portion 120. In the illustrative embodiment, the connecting portion 150, the housing 111, and the housing 121 constitute an inseparable one-piece structure. With this configuration, the first accommodating portion 110 and the connecting portion 150 are also fixed to the lower cover 30 by fixing of the second accommodating portion 120 to the lower wall 31 of the lower cover 30. In the state where the second accommodating portion 120 is fixed to the lower wall 31 of the lower cover 30, the first accommodating portion 110 is located vertically below the space 34 of the lower cover 30 and the first accommodating portion 120 is located vertically below the space 35 of the lower cover 30.

The connecting portion 150 has a waste ink passage that has the same cross-sectional area at any sectional position between the communication opening 131 and the communication opening 132. The cross-sectional area of the waste ink passage in the connecting portion 150 is smaller than a cross-sectional area of a waste ink passage in the projecting portion 111*b* of the first accommodating portion 110 and a cross-sectional area of a waste ink passage at the communication opening 132 in the second accommodating portion 120. The passage cross-sectional area may be a cross-sectional area of a waste ink passage cut perpendicularly relative to a direction in which waste ink moves in the case 91.

The absorber 92 accommodated in the case 91 includes the first absorbing member 160, the second absorbing member 170, and the third absorbing member 180. The first absorbing member 160 is accommodated in the first accommodating portion 110. The second absorbing member 170 is accommodated in the second accommodating portion 120. The third absorbing member 180 is accommodated in the connecting portion 150. In this illustrative embodiment, the first absorbing member 160, the second absorbing member 170, and the third absorbing member 180 are independent from each other. Nevertheless, in other embodiments, for example, the first absorbing member 160, the second absorbing member 170, and the third absorbing member 180 may be an inseparable one-piece absorber.

The first absorbing member 160 extends to both the first subspace 140*a*, which is inside the joint portion 115, and the second subspace 141, which is outside the joint portion 115. Thus, in a state where the first waste-liquid tank 80 and the second waste-liquid tank 90 are fixed to the lower cover 30, the absorber 83 of the first waste-liquid tank 80 inserted in the inlet 119 is in press contact with a portion of the first absorbing member 160 located in the first subspace 140. Thus, waste ink that has flowed into the internal space of the body case 81 of the first waste-liquid tank 80 moves to the internal space of the first accommodating portion 110 of the second waste-liquid tank 90, and is absorbed and held by the first absorbing member 160.

The third absorbing member 180 is in contact with the first absorbing member 160 accommodated in the first accommodating portion 110 and the second absorbing member 170 accommodated in the second accommodating portion 120. Thus, waste ink absorbed by the first absorbing member 160 moves to the second accommodating portion 120 through the third absorbing member 180, and thus is absorbed and held by the second absorbing member 170.

In response to reaching the waste ink absorbing limit, the second waste-liquid tank 90 is removed from the lower wall 31 of the lower cover 30 and is replaced with a new one. The second waste-liquid tank 90 can be replaced with a new one in a simple operation. More specifically, for example, the screws 129 fastening the second waste-liquid tank 90 are removed from the bottom of the multifunction device 10 to disengage the engagement portion 126 of the second waste-liquid tank 90 from the lower cover 30. As described above, the replacing operation might not require disassembling of the multifunction device 10 such that a user can access the interior of the printer 14, e.g., the purge mechanism 70. During replacement of the second waste-liquid tank 90, waste ink is also absorbed and held by the absorber 83 in the first waste-liquid tank 80. Therefore, in a state where the cylindrical portion 87 of the first waste-liquid tank 80 is exposed by removal of the second waste-liquid tank 90 from the lower cover 30, waste ink does not drop from the first waste-liquid tank 80 nor does not move to the outside of the first waste-liquid tank 80.

If the used second waste-liquid tank 90 is tilted such that the inlet 119 is located lower than the second accommodating portion 120 after removed from the lower cover 30, waste ink held in the second accommodating portion 120 may leak from the second accommodating portion 120 via the inlet 119 by its own weight. Nevertheless, in the illustrative embodiment, the second accommodating portion 120 includes the ribs 125 protruding upward from the lower wall 122 and each having the hook-like bent distal end. With this configuration, if the second waste-liquid tank 90 is tilted as described above, the ribs 125 may stop and hold waste ink to reduce or prevent the waste ink from moving downward or dropping from the second accommodating portion 120. This configuration may therefore reduce leakage of waste ink from the second accommodating portion 120 via the inlet 119.

In order to have the absorber 92 hold a relatively-large amount of waste ink in the second waste-liquid tank 90, it may be preferable that the absorber 92 accommodated in the case 91 have a larger volume. Therefore, it is conceivable that the amount of waste ink that the second waste-liquid tank 90 can hold may be increased if the absorber 92 occupies the entirety of the case 91. However, if the absorber 92 is provided in such a manner in the case 91 of the second waste-liquid tank 90 of the illustrative embodiment, the waste ink holding capability of the second waste-liquid tank 90 may be impaired. Hereinafter, the reasons for capability impairment will be described.

As described above, the inlet 119 of the first accommodating portion 110 is the only opening that is in communication with the atmosphere in the case 91. Therefore, in order to cause waste ink to move from upstream to downstream in the case 91 in an ink passage route, air needs to be moved from downstream to upstream in the ink passage route. Thus, in order to increase the waste ink holding capability of the second waste-liquid tank 90, air needs to be allowed to move from a downstream end portion of the second accommodating portion 120 to the inlet 119.

Unless the absorber 92 has been clogged with waste ink, air and waste ink are both allowed to move through the absorber 92. Thus, if the absorber 92 occupies the substantial entirety of the case 91, air can move through the absorber 92.

Nevertheless, the absorber 92 may become clogged with waste ink absorbed therein. For example, the connecting portion 150 extends in the horizontal direction. Therefore, waste ink might not move to the second accommodating portion 120 from the connecting portion 150 by its own weight. In addition, the cross-sectional area of the connecting portion 150 is smaller than the cross-sectional area of the projecting portion 111*b*. Therefore, a relatively large amount of waste ink tends to stay in the third absorbing member 180 accommodated in the connecting portion 150. In addition, waste ink may become thicker due to evaporation of moisture due to the lapse of time. These functions may cause clogging of the third absorbing member 180 with waste ink having increased viscosity with higher possibility. If the absorber 92 becomes clogged with waste ink having increased viscosity, the clogged portion in the absorber 92 blocks air flow from downstream to upstream in the ink passage route.

In the illustrative embodiment, the film 136 constituting the upper wall of the second accommodating portion 120 has flexibility. With this configuration, if the second absorbing member 170 accommodated in the second accommodating portion 120 becomes clogged with waste ink having increased viscosity, the film 136 deforms to provide a clearance between the film 136 and the second absorbing member 170, and the clearance allows air to move from downstream to upstream in the ink passage route over the clogged portion in the second accommodating portion 120. Thus, in the second accommodating portion 120, such an air movement from downstream to upstream in the ink passage route over the clogged portion of the second absorbing member 170 may cause the clogging waste ink to move downward to clear the clogging caused by the waste ink. If waste ink whose viscosity has increased by drying clogs the second absorbing member 170, waste ink having lower viscosity that comes into the second absorbing member 170 through the inlet 119 at a later time may contact the clogging waste ink to cause the viscosity of the clogging waste ink to be lower. After the viscosity of the clogging waste ink becomes lower, the clogging waste ink moves downstream in the ink passage route. As described above, providing flexibility to the upper wall of the second accommodating portion 120 may enable the second absorbing member 170 accommodated in the second accommodating portion 120 to absorb waste ink in its entirety although the second absorbing member 170 occupies the substantial entirety of the second accommodating portion 120.

Similar to the film 136, the film 135 constituting the upper wall of the second subspace 141 of the first accommodating portion 11 has flexibility. With this configuration, if the first absorbing member 160 positioned in the second subspace 141 becomes clogged with waste ink having increased viscosity, the film 135 deforms to provide a clearance between the film 135 and the first absorbing member 160, and the clearance allows air to move from downstream to upstream in the ink passage route over the clogged portion. Thus, in the second subspace 141, such an air movement from downstream to upstream in the ink passage route over the clogged portion of the first absorbing member 160 may cause the clogging waste ink to move downward in the ink passage route to clear the clogging caused by the waste ink.

The lower wall 151, the front wall 152, the rear wall 153, and the upper wall 154 constituting the surrounding walls of the connecting portion 150 have higher stiffness than the films 135 and 136, and therefore, each of the lower wall 151, the front wall 152, the rear wall 153, and the upper wall 154 deforms less than the films 135 and 136. Thus, in a case where third absorbing member 180 occupies the substantial entirety of the connecting portion 150, waste ink may clog the connecting portion 150. That is, waste ink may clog the third absorbing member 180. Therefore, air cannot move from downstream to upstream over the clogged portion in the ink passage route. Accordingly, waste ink is not allowed to move from the first accommodating portion 110 to the second accommodating portion 120 although the second absorbing member 170 accommodated in the second accommodating portion 120 which is disposed downstream from the connecting portion 150 is still capable of absorbing waste ink.

Similar to this, the joint portion 115 and the lower wall 112 constituting the surrounding walls defining the second area 140*b* of the first subspace 140 in the first accommodating portion 110 have higher stiffness than the films 135 and 136, and therefore, each of the joint portion 115 and the lower wall 112 deforms less than the films 135 and 136. Thus, in a case where the first absorbing member 160 occupies the substantial entirety of the second area 140*b*, air cannot move from downstream to upstream over the clogged portion in the ink passage route if the first absorbing member 160 becomes clogged with waste ink. Accordingly, waste ink is not allowed to move downstream beyond the second area 140*b* in the ink passage route.

As described above, if the absorber 92 occupies the substantially entirety of the case 91, the waste liquid holding capability of the second waste-liquid tank 90 may be impaired. In order to solve such a problem, in the illustrative embodiment, the case 91 has an air escape space 190 that is not occupied by any portions of the absorber 92. The air escape space 190 includes a first space 191 and a connecting-portion space 193. The first space 191 is provided in the first accommodating portion 110. The connecting-portion space 193 is provided in the connecting portion 150.

As illustrated in FIG. 9A, the third absorbing member 180 does not occupy the entirety of the connecting portion 150. More specifically, for example, the third absorbing member 180 has a rectangular parallelepiped shape with its width in the front-rear direction shorter than a width of the internal space of the connecting portion 150 in the front-rear direction. Further, the third absorbing member 180 is disposed such that a clearance is left between the third absorbing member 180 and the rear wall 153 of the connecting portion 150 from the communication opening 131 to the communication opening 132. The clearance provided between the third absorbing member 180 and the rear wall 153 of the connecting portion 150 may serve as the connecting-portion space 193. In this illustrative embodiment, the connecting-portion space 193 may be provided by such a simple way in which the clearance is provided between the third absorbing member 180 and the rear wall 153 of the connecting portion 150.

In another example, a clearance may be left between the upper wall 154 and the third absorbing member 180 to provide the connecting-portion space 193. Nevertheless, as described above, the distance between the lower wall 151 and the upper wall 154 in the top-bottom direction is shorter than the distance between the front wall 152 and the rear wall 153 in the front-rear direction. Therefore, in this case, if the third absorbing member 180 has the same volume as the third absorbing member 180 of the illustrative embodiment, a relatively small clearance may be provided between the third absorbing member 180 and the wall (e.g., the upper wall 154) facing the third absorbing member 180 apart therefrom via the connecting-portion space in the surrounding walls of the connecting portion 150. In the case 91, waste ink may ooze from the absorber 92. Therefore, in a case where the clearance between the third absorbing member 180 and the wall facing the third absorbing member 180 is relatively small, the waste ink oozed from the absorber 92 tends to contact the wall, and thus the connecting portion 150 may become clogged with the waste ink with higher possibility. Nevertheless, in the illustrative embodiment, the clearance is left between the rear wall 153 and the third absorbing member 180 to provide the connecting-portion space 193. Therefore, the relatively large clearance may be provided between the third absorbing member 180 and the wall (e.g., the rear wall 153) facing the third absorbing member 180. That is, as compared with the alternative method, in the illustrative embodiment, the third absorbing member 180 may be disposed at a position farther from the wall facing the third absorbing member 180 apart therefrom via the connecting-portion space. Therefore, while enabling the third absorbing member 180 to have an appropriate volume, this configuration may enable to reduction of clogging of the connecting portion 150 with waste ink oozed from the absorber 92.

The connecting-portion space 193 is defined by the rear wall 153, a portion of the upper wall 154, a portion of the lower wall 151, and a rear surface of the third absorbing member 180. That is, the connecting-portion space 193 borders on the upper wall 154 and the lower wall 151. The connecting-portion space 193 has the same cross-sectional area at any sectional position between the communication opening 131 and the communication opening 132.

As described above, the connecting-portion space 193 is provided in the connecting portion 150. This configuration may therefore reduce the occurrence possibility of clogging of the connecting portion 150 with waste ink if the third absorbing member 180 becomes clogged with waste ink. Thus, air may be discharged into the first accommodating portion 110 from the second accommodating portion 120 via the connecting portion 150. This may therefore result in enabling the second accommodating portion 120 to absorb and hold a relatively large amount of waste ink, which may minimize impairment of the waste ink holding capability of the second waste-liquid tank 90.

The connecting-portion space 193 extends from the communication opening 131 to the communication opening 132. This configuration may therefore enable air to be discharged into the first accommodating portion 110 readily. Because air is lighter than waste ink, air moves upward toward the upper wall 154 in the connecting portion 150. In the illustrative embodiment, the connecting-portion space 193 borders on the upper wall 154 of the connecting portion 150. This configuration may therefore enable air to be discharged into the first accommodating portion 110 via the connecting-portion space 193 smoothly.

The connecting-portion space 193 is provided between the third absorbing member and the rear wall 152, which is closer to the inlet 119 than the front wall 153. This configuration may therefore enable shortening of the distance between the connecting-portion space 193 and the inlet 119, and thus, air in the second accommodating portion 120 may be discharged to the inlet 119 smoothly.

Providing the connecting-portion space 193 in the connecting portion 150 may reduce the passage cross-sectional area of the third absorbing member 180 correspondingly. If the passage cross-sectional area of the third absorbing member 180 is too small, a rate of flow of waste ink that can move through the third absorbing member 180 per unit time may be less than a rate of flow of waste ink that penetrates into the third absorbing member 180 per unit time when the purge mechanism 70 performs purging in the strong purge mode. If such a situation occurs, the third absorbing member 180 might not absorb all waste ink therein and thus some waste ink may ooze to the connecting-portion space 193 from the third absorbing member 180 and stay there. This may increase the possibility of clogging of the connecting-portion space 193 with the oozed waste ink. This problem may occur significantly if the passage cross-sectional area of the connecting portion 150 is relatively small.

Figure 10A:
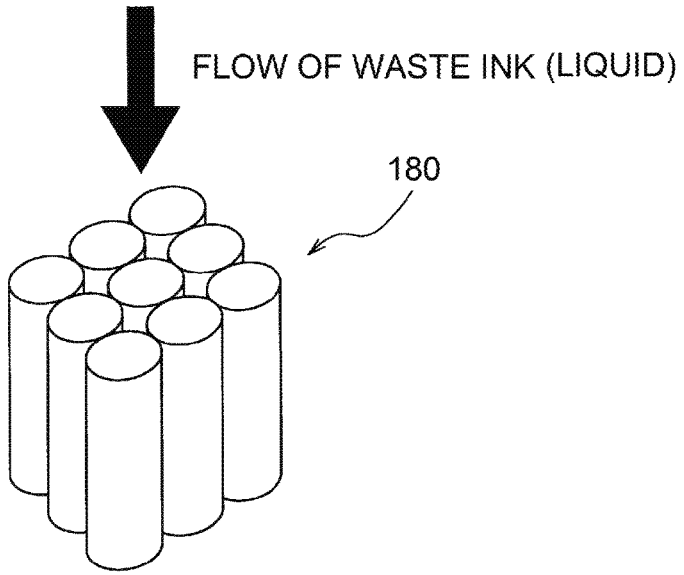
FIG. 10A is a schematic perspective view of a third absorbing member in the illustrative embodiment according to one or more aspects of the disclosure.
Figure 10B:
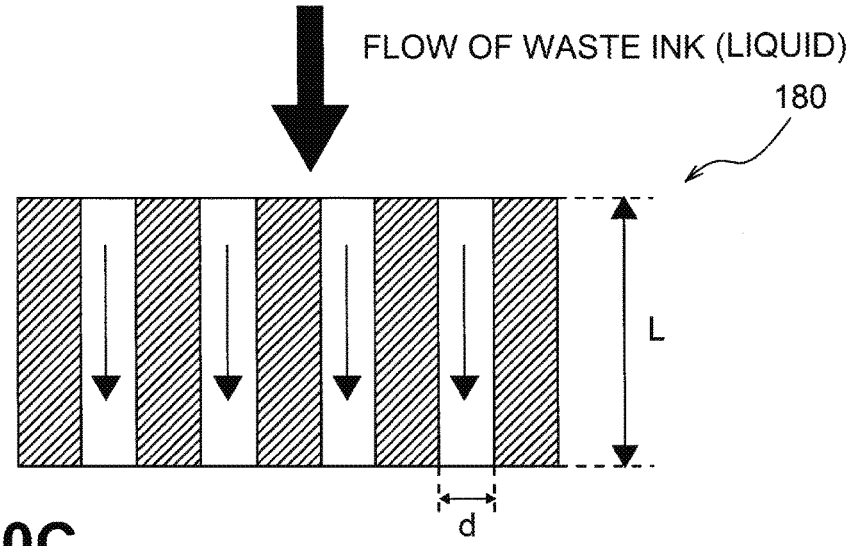
FIG. 10B is a schematic sectional view of the third absorbing member in the illustrative embodiment according to one or more aspects of the disclosure.

Therefore, in the illustrative embodiment, the passage cross-sectional area of the third absorbing member 180 (hereinafter, referred to as a passage cross-sectional area Af) may be determined such that, in a state where the third absorbing member 180 is not clogged with waste ink having increased viscosity, waste ink that flows into the inlet 119 when the purge mechanism 70 performs purging in the strong purge mode can move through the third absorbing member 180 without oozing to the connecting-portion space 193. Hereinafter, a description will be made how to determine the passage cross-sectional area Af. As illustrated in FIGS. 10A and 10B, assuming that the third absorbing member 180 includes a group of tubes having the same inside diameter and the same length, and the tubes are arranged in the right-left direction in the connecting portion 150.

The passage cross-sectional area Af of the third absorbing member 180 is expressed by Expression 1. More specifically, the passage cross-sectional area Af is not smaller than a value obtained by dividing a maximum rate of flow of waste ink that flows into the inlet 119 per unit time when the purge mechanism 70 performs purging in the strong purge mode by a rate of flow of waste ink per unit of time per unit of passage cross-sectional area of the third absorbing member 180 (e.g., flow rate J).

$$Af \geq Q/J \qquad \text{Expression 1}$$

The rate of flow per unit of time per unit of passage cross-sectional area of the third absorbing member 180 may be expressed by Expression 2.

$$J = N \cdot \pi \cdot d^4 \cdot \Delta P / 128\ \mu L \qquad \text{Expression 2}$$

J: rate of flow per unit of time per unit of passage cross-sectional area ($m^3/m^2 \cdot S$)

N: number of tubes per unit of passage cross-sectional area ($1/m^3$)

d: inside diameter of tube (m)

ΔP: pressure difference between ends of tube (Pa)

μ: viscosity of waste ink (liquid) (Pa·s)

L: tube length (m)

The passage cross-sectional area Af of the third absorbing member 180 is determined so as to satisfy Expression 1. By doing so, when the purge mechanism 70 performs purging in the strong purge mode, waste ink may move through the third absorbing member 180 without oozing to the connecting-portion space 193.

Hereinafter, the first space 191 will be described in detail. The first space 191 is a space that is not occupied by any portions of the first absorbing member 160 in the first accommodating portion 110. The first space 191 includes rectangular parallelepiped spaces 191*a* and 191*b*. The rectangular parallelepiped space 191*a* is located below the joint portion 115 and extends beyond the front and rear openings of the joint portion 115 in the front-rear direction. The rectangular parallelepiped space 191*b* extends in the right-left direction and connects between the rectangular parallelepiped space 191*a* and the connecting-portion space 193. That is, the first space 191 extends from the communication opening 131 to the inlet 119 via the second subspace 141, the second area 140*b* of the first subspace 140, and the first area 140*a* of the first subspace 140 in this order. The first absorbing member 160 does not occupy the first space 191 in the first accommodating portion 110 in top plan view. That is, the first space 191 borders the lower wall 112 entirely.

As described above, providing the first space 191 in the first accommodating portion 110 may enable reduction of the possibility of clogging of the second area 140*b* with waste ink defined by the surrounding walls having a relatively high stiffness, and may also enable discharge of air into the inlet 119 from the second subspace 141, similar to the connecting portion 150. The first space 191 is in communication with the connecting-portion space 193. Therefore, air that has moved to the connecting-portion space 193 from the second accommodating portion 120 may be discharged into the inlet 119 via the first space 191 readily. This may thus enable a relatively large amount of waste ink to flow into the second accommodating portion 120, which may minimize impairment of the waste ink holding capability of the second waste-liquid tank 90.

The passage cross-sectional area of the first absorbing member 160 accommodated in the first accommodating portion 110 is greater than the passage cross-sectional area of the third absorbing member 180. Therefore, waste ink that flows into the inlet 119 when the purge mechanism 70 performs purging in the strong purge mode may move through the third absorbing member 160 without oozing to the connecting-portion space 191.

Absorbent performance of the absorber 92 may be impaired temporarily. For example, if the viscosity of waste ink absorbed in the absorber 92 increases, the waste ink may clog the absorber 92, and thus the absorbent performance of the absorber 92 may be impaired. Nevertheless, this may be recovered by waste ink having lower viscosity. More specifically, waste ink having lower viscosity that penetrates into the absorber 92 through the inlet 119 at a later time contacts waste ink having increased viscosity to cause the viscosity of the waste ink having increased viscosity to be lower. Thus, the waste ink having increased viscosity may be dispersed in the absorber 92. Accordingly, the absorbent performance of the absorber 92 may be recovered.

If the purge mechanism 70 performs purging in the strong purge mode while the absorbent performance of the absorber 92 is impaired temporarily, the absorber 92 might not absorb all waste ink that has penetrated into the absorber 92 through the inlet 119 and thus the waste ink may move backward along the ink passage route to leak from the inlet 119.

In the illustrative embodiment, therefore, the air escape space 190 has a volume greater than a volume of waste ink that flows into the inlet 119 when the purge mechanism 70 performs purging in the strong purge mode (hereinafter, referred to as a purge volume). With this configuration, the air escape space 190 may be used as a buffer space for holding waste ink temporarily.

If the air escape space 190 includes the connecting-portion space 193 and the first space 191 only, a total volume of the connecting-portion space 193 and the first space 191 needs to be greater than the purge volume. Nevertheless, the passage cross-sectional area of the third absorbing member 180 is required to satisfy Expression 1. Therefore, the volume of the connecting-portion space 193 has an upper limit. Similar to the connecting-portion space 193, the volume of the first space 191 has an upper limit in relation to the passage cross-sectional area of the first absorbing member 160. Thus, the total volume of the connecting-portion space 193 and the second space 191 might not to be set to be greater than the purge volume.

In the illustrative embodiment, the air escape space 190 includes a second space 192 as well as the first space 191 and the connecting-portion space 193. The second space 192 is a space that is not occupied any portions of the second absorbing member 170 in the second accommodating portion 120. The second space 192 may be a rectangular parallelepiped space extending in the right-left direction. The second space 192 is in communication with the connecting-portion space 193 via its right end. The second absorbing member 170 does not occupy the second space 192 in the second accommodating portion 120 in top plan view. That is, the second space 192 borders the lower wall 122 entirely. The passage cross-sectional area of the second absorbing member 170 is greater than or equal to the passage cross-sectional area of the third absorbing member 180. As described above, the air escape space 190 has the second space 192 as well as the first space 191. Therefore, the air escape space 190 may have a volume greater than the purge volume.

If the connecting-portion space 193 is filled with waste ink oozed from the absorber 92 while the absorbent performance of the absorber 92 is impaired temporarily, waste ink having increased viscosity staying in the third absorbing member 180 and waste ink staying in the connecting-portion space 193 may clog the connecting portion 150. If the connecting portion 150 becomes clogged with waste ink, the waste ink remaining in the first accommodating portion 110 cannot be caused to move to the second accommodating portion 120.

Figure 10C:
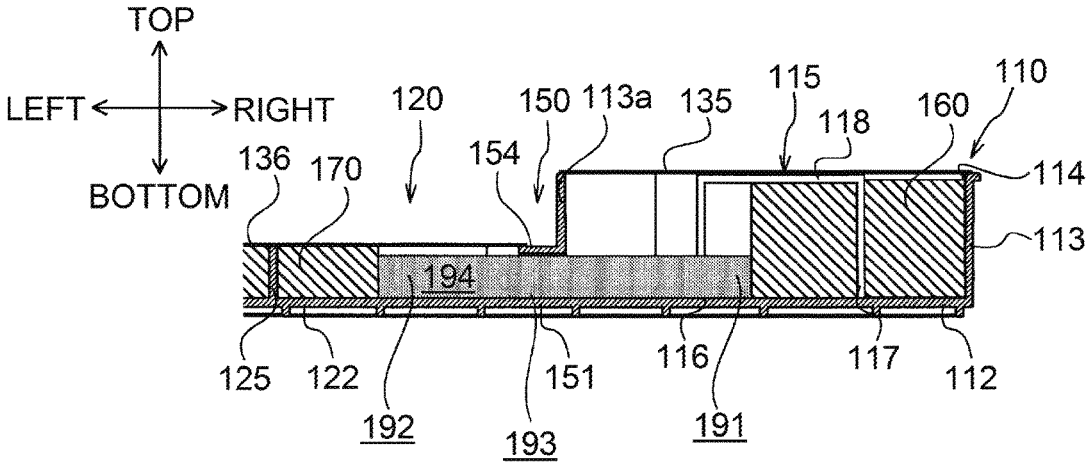
FIG. 10C is a sectional view taken along line II-II of FIG. 7 illustrating an air escape space in the illustrative embodiment according to one or more aspects of the disclosure.

In the illustrative embodiment, in the air escape space 190, a volume of a space 194 (refer to FIG. 10C) having a height no higher than the level of the upper wall 154 of the connecting portion 150 is greater than the purge volume. If the absorber 92 can absorb no waste ink that has flowed into the inlet 119 by purging in the strong purge mode and the waste ink oozes to the air escape space 190, such a configuration may enable reduction of the possibility of clogging of the connecting portion 150 with the waste ink. As described above, the inlet 119 is located higher than the connecting portion 150. Therefore, if waste ink oozes to the air escape space 190, the waste ink does not leak from the inlet 119.

In the illustrative embodiment, a bottom surface area of the first space 191 is greater than a bottom surface area of the second space 192. In the illustrative embodiment, in the space 194 having a height no higher than the level of the upper wall 154 of the connecting portion 150 in the air escape space 190, a partial space occupying the first accommodating portion 110 partially has a greater volume than a partial space occupying the second accommodating portion 120 partially. That is, a volume V1 of the partial space that is defined below the upper end of the connecting-portion space 193 in the first space 191 is greater than a volume V2 of the partial space that is defined below the upper end of the connecting-portion space 193 in the second space 192. In a case where waste ink oozed from the absorber 92 remains in the air escape space 190, more ink stays at a location closer to the inlet 119. Therefore, in a case where the volume V1 is relatively small, the connecting portion 150 tends to become clogged with the waste ink accumulated in the air escape space 190. In the illustrative embodiment, the volume V1 is greater than the volume V2. This configuration may reduce the possibility of clogging of the connecting portion 150 with the waste ink accumulated in the air escape space 190.

The second waste-liquid tank 90 corresponds to a waste liquid tank. The multifunction device 10 corresponds to a printer. The inlet 119 corresponds to a liquid inlet. The communication opening 131 corresponds to a first communication opening. The communication opening 132 corresponds to a second communication opening. The first area 140*a* corresponds to a first area. The second area 140*b* corresponds to a second area. The second subspace 141 corresponds to a second subspace. The purge mechanism 70 corresponds to a discharge device.

While the disclosure has been described in detail with reference to the specific embodiment thereof, this is merely an example, and various changes, arrangements and modifications may be applied therein without departing from the spirit and scope of the disclosure. Hereinafter, various alternative embodiments will be described. An explanation will be given mainly for the parts different from the first illustrative embodiment, and an explanation will be omitted for the common components by assigning the same reference numerals thereto.

In the illustrative embodiment, the connecting-portion space 193 occupies the entire portion of the connecting portion 150 from the communication opening 131 to the communication opening 132 along the right-left direction. Nevertheless, in other embodiments, for example, the connecting-portion space 193 may occupy a partial portion of the connecting portion 150 between the communication openings 131 and 132 along the right-left direction. In this case, air might not move from the second accommodating portion 120 to the first accommodating portion 110 smoothly as compared with the illustrative embodiment. Nevertheless, as compared with a case where no connecting-portion space 193 is provided, air can move from the second accommodating portion 120 to the first accommodating portion 110 smoothly.

In the illustrative embodiment, the connecting-portion space 193 is provided between the rear wall 153 of the connecting portion 150 and the third absorbing member 180. Nevertheless, in other embodiments, for example, the connecting-portion space 193 may be provided between the lower wall 51 and the third absorbing member 180. In other embodiments, for example, the third absorbing member 180 may have a tubular shape and its internal space may serve as a connecting-portion space. In the illustrative embodiment, the connecting-portion space 193 borders on the upper wall 154. Nevertheless, in other embodiments, the connecting-portion space 193 might not necessarily border on the upper wall 154.

In the illustrative embodiment, the third absorbing member 180 is in contact with the first absorbing member 160 and the second absorbing member 170. Nevertheless, in other embodiments, for example, the third absorbing member 180 might not necessarily be in contact with the first absorbing member 160 and the second absorbing member 170.

In the illustrative embodiment, the connecting portion 150 extends linearly in the horizontal direction. Nevertheless, in other embodiments, for example, the connecting portion 150 may extend in the up-down direction. That is, the first accommodating portion 110 may be located higher than the second accommodating portion 120. The connecting portion 150 may extend curvedly.

In other embodiments, for example, if the volume of the connecting-portion space 193 is larger than the purge volume, the air escape space 190 may have the connecting-portion space 193 only. In other words, the air escape space 190 does not have the first space 191 and the second space 192. In other embodiments, for example, the air escape space 190 may have the connecting-portion space 193 and one of the first space 191 and the second space 192.

The flexible films 135 and 136 are used as the upper wall of the second subspace 141 of the first accommodating portion 110 and the upper wall of the second accommodating portion 120, respectively. Nevertheless, in other embodiments, for example, the upper wall of the second subspace 141 of the first accommodating portion 110 and the upper wall of the second accommodating portion 120 may be made of, for example, synthetic resin or plastic similar to the housings 111 and 121 and have the same degree of stiffness as the housings 111 and 121.

In the illustrative embodiment, the waste liquid tank for holding waste ink therein corresponds to the waste liquid tank, and the multifunction device 10 corresponds to the printer. Nevertheless, the disclosure may be applied to other waste liquid tanks and other printers. The disclosure may be applied to a waste liquid tank for holding liquid other than ink, and may be applied to a printer that uses liquid other than ink.

What is claimed is:

1. A waste liquid tank configured to hold waste liquid of a printer, the waste liquid tank comprising:

a case including a first accommodating portion having an inlet and a first communication opening, a second accommodating portion having a second communication opening, and a connecting portion connecting the first communication opening and the second communication opening, wherein a cross-sectional area of the connecting portion is less than a cross-sectional area of the first accommodating portion and is less than a cross-sectional area of the second accommodating portion;

a first absorber accommodated in the first accommodating portion;

a second absorber accommodated in the second accommodating portion; and a third absorber accommodated in the connecting portion, wherein the connecting portion includes a passage defined between the third absorber and a peripheral portion of the connecting portion, the passage allowing the first accommodating portion to communicate with the second accommodating portion and for air to pass therethrough.

2. The waste liquid tank according to claim 1, wherein the connecting portion includes surrounding walls that surround the third absorber, the peripheral portion constituting one of the surrounding walls.

3. The waste liquid tank according to claim 2, wherein the connecting portion extends from the first accommodating portion to the second accommodating portion in a first direction, wherein the surrounding walls include an upper wall and a lower wall, and wherein the passage is further defined between the upper wall and the lower wall.

4. The waste liquid tank according to claim 3, wherein the second accommodating portion includes a housing having an upper opening and a film covering the upper opening, and wherein a rigidity of the upper wall of the connecting portion is greater than a rigidity of the film.

5. The waste liquid tank according to claim 3, wherein the surrounding walls further include a pair of inner side walls, and wherein the third absorber is separated from at least one of the pair of inner side walls.

6. The waste liquid tank according to claim 5, wherein the pair of inner side walls is disposed to be separated from each other in a second direction intersecting the first direction, wherein the pair of inner side walls is disposed to be spaced from the inlet in the second direction, and wherein a distance between one of the pair of inner side walls and the inlet in the second direction is smaller than a distance between the other of the pair of inner side walls and the inlet in the second direction.

7. The waste liquid tank according to claim 5, wherein the peripheral portion constitutes one of the inner side walls.

8. The waste liquid tank according to claim 3, wherein the second accommodating portion is next to the connecting portion in the first direction.

9. The waste liquid tank according to claim 1, wherein the connecting portion extends from the first accommodating portion to the second accommodating portion in a first direction, and the inlet is spaced from the connecting portion in a second direction intersecting the first direction.

10. The waste liquid tank according to claim 1, wherein the first accommodating portion includes a first portion where the first absorber is not accommodated, and wherein the first portion and the passage communicate with each other.

11. The waste liquid tank according to claim 10, wherein the first portion communicates with the inlet and the first communication opening to allow air to pass through the first portion.

12. The waste liquid tank according to claim 1, wherein the second accommodating portion includes a second portion where the second absorber is not accommodated, and wherein the second portion and the passage communicate with each other.

13. The waste liquid tank according to claim 1, wherein the first accommodating portion includes a first portion where the first absorber is not accommodated, wherein the second accommodating portion includes a second portion where the second absorber is not accommodated, wherein the first portion and the second portion communicate with the passage, wherein the connecting portion extends from the first accommodating portion to the second accommodating portion in a first direction, wherein the first portion includes a lower area spaced from the connecting portion in a second direction intersecting the first direction and the second portion includes a lower area spaced from the connecting portion in a second direction intersecting the first direction in a state that the waste liquid tank is attached to the printer, and wherein a volume of the lower area of the first portion is greater than a volume of the lower area of the second portion.

14. The waste liquid tank according to claim 1, wherein a cross sectional area of the third absorber is smaller than a cross sectional area of the first absorber.

* * * * *